US006389669B1

(12) United States Patent
Moscone

(10) Patent No.: US 6,389,669 B1
(45) Date of Patent: May 21, 2002

(54) DOCTOR BLADE EXTRACTOR

(76) Inventor: John Moscone, 76 Old Dover Rd., Rochester, NH (US) 03867

( * ) Notice: Subject to any disclaimer, the term of this patent is extended or adjusted under 35 U.S.C. 154(b) by 0 days.

(21) Appl. No.: 09/577,869

(22) Filed: May 24, 2000

Related U.S. Application Data

(60) Provisional application No. 60/136,016, filed on May 25, 1999.

(51) Int. Cl.[7] ..... B25B 27/00

(52) U.S. Cl. ..... 29/278

(58) Field of Search ..... 29/270, 262, 265, 29/278, 253, 426.5, 283, 426.1; 254/18, 30; 294/104, 110.2, 106

(56) References Cited

U.S. PATENT DOCUMENTS

| | | | | |
|---|---|---|---|---|
| 263,783 A | * | 9/1882 | Hood | 254/18 |
| 2,543,017 A | | 2/1951 | Hagan | |
| 2,549,918 A | | 4/1951 | Miller | |
| 3,253,850 A | | 5/1966 | Trusty | |
| 4,367,120 A | | 1/1983 | Hendrikz | |
| 4,665,859 A | | 5/1987 | Dunlap et al. | |
| 4,821,672 A | | 4/1989 | Bruno | |
| 5,101,725 A | | 4/1992 | Kobler et al. | |
| 5,279,710 A | | 1/1994 | Aikawa | |
| 5,406,887 A | | 4/1995 | Hertel et al. | |
| 5,417,761 A | | 5/1995 | Bernert | |
| 5,980,692 A | | 11/1999 | Goodnow et al. | |
| 5,983,798 A | | 11/1999 | Iijima et al. | |

* cited by examiner

*Primary Examiner*—Robert C. Watson
(74) *Attorney, Agent, or Firm*—Hayes, Soloway, Hennessey, Grossman & Hage PC

(57) ABSTRACT

An apparatus and method for extracting a doctor blade from paper making machines including a clamping and locking mechanism that tightens as more force is applied to the device in the extraction process. The apparatus may include a hollow steel handle or outer shaft, a locking linkage shaft slidably disposed within the steel outer shaft, and a rotatably mounted gripping mechanism coupled to the linkage. A trigger mechanism attached to the linkage shaft causes the gripping mechanism to rotate against the doctor blade, gripping the blade between contact surfaces. A safety locking ring may be provided for securing the linkage shaft in a closed position. As force is applied against the extractor, the gripping action is increased by the frictional action exerted by the gripping mechanism on the doctor blade.

13 Claims, 3 Drawing Sheets

DOCTOR BLADE EXTRACTOR

This application claims benefit of Prov. No. 60/136,016 filed May 25, 1999.

FIELD OF THE INVENTION

The present invention relates generally to a doctor blade extractor for doctor blades used in papermaking machines.

BACKGROUND OF THE INVENTION

Doctor blades are well known and are used where revolving rolls are employed to move or form paper. These blades are made of metal, plastic, and graphite fiber. The doctor blade is placed in contact with the revolving roll to keep the roll clean and/or shed the sheet. The blade must be flat, straight and parallel, and its composition must be compatible with the roll to be doctored. Because they are in contact with the roll, the edges of these blades get sharpened to a near razor sharpness.

The blade holder exerts a uniform load pressure on the blade. It holds the blade firmly against the roll, accommodates roll irregularities, and within limits, compensates for thermal expansion. Doctor blade holder designs normally comprise a body member having a slot adapted to receive a doctor blade with the doctoring edge of the blade projecting from the open end of the slot. The blade is normally mounted in the holder with a series of fasteners.

A common problem with known blade holders, however, is that the restrict the extraction of the blades from the holder. In some cases, the holder must be removed from the paper machine to remove the blade. This requires extensive manpower and machine downtime. After removing the blade, the assembly must be re-installed in the paper machine, consuming more manpower and time. Further, in many cases, the blades are installed in locations that require a long reach across a paper machine frame or other equipment, and they are situated in such a way as to make the attachment of most mechanical devices used for extraction difficult.

Doctor blade holders generally are not provided with a tension relieving mechanism, and the blades are held by a considerable amount of friction making the removal difficult and dangerous. A wide machine further compounds this problem by adding the added length of the holder and therefore a corresponding amount of added friction to the removal of the blades. In addition, the build-up of scale and debris, particularly in holders where the blades are not removed frequently, further adds to the friction. Chemicals used in paper making also compounds the problem by corroding the holder and blade.

Another problem is that sharp doctor blades are known to cause injury. Blades can be located in areas where a reach across the frame of a machine is required to access the edges of the doctor blades. This length of reach can exceed the length of a normal person's arm. Reaching an arm into locations that are dimly lit and small in their opening can result in personnel injuring themselves on sharp metal edges of the machine.

Current methods of extraction employ tools that a generic in nature, such as the tool sold under the trade name VICF GRIP. In general, these tools only grip and hold a blade by way of downward friction force. However, such devices can slip when sufficient tension is applied to the extraction of the blades, simultaneously being ineffective and posing a serious safety risk. Another current method of extraction uses a hook similar to a cargo hook that fits into a ⅛" hole drilled in the ends of doctor blades. If the hook can be inserted in this hole, then the hook can effectively be employed. However, many blades are in locations that cannot be accessed by the hook. This requires that the blade be forced out about four to five inches from the back side of the machine by personnel before the hook can engage the drilled hole. This procedure uses added personnel and takes added time.

It is, therefore, an object of the present invention to overcome these deficiencies of the prior art and to provide an improved doctor blade extractor. Another object of the invention is to provide a safer, more effective, and reliable mechanism for removing a doctor blade from its associated holder. These and other objects of the present invention will become apparent from a review of the description provided below.

SUMMARY OF THE INVENTION

The doctor blade extractor of the present invention provides an effective and reliable mechanism for removing a doctor blade from an associated holder. In particular, an extractor consistent with the invention may include a head portion including at least one gripping member, and a linkage shaft. The linkage shaft is coupled to the at least one gripping member and is movable relative to the head portion between a closed position wherein the at least one gripping member is positioned to engage a doctor blade, and an open position wherein the at least one gripping member is positioned to release the doctor blade. A locking member may be provided for releasably locking the linkage shaft in the closed position.

The linkage shaft may be slidably disposed in a hollow shaft, and a trigger extending from the linkage shaft through a slot in the hollow shaft may be provided for moving the linkage shaft between the open and closed positions. The linkage shaft may be biased into the closed position by a spring coupled thereto. The locking member may include a locking ring having threads thereon for meshingly engaging corresponding threads on an interior of the hollow shaft, and the locking ring may be rotatable into the hollow shaft for engaging the linkage shaft in the closed position.

In one exemplary embodiment, the at least one gripping member may include a pivoting cam shoe coupled to the linkage shaft through a pin. The head portion may further include a stationary platform shoe, and the cam shoe may be adapted for forcing the doctor blade against the platform shoe when the linkage arm is in the closed position. In another exemplary embodiment, the head portion may comprise a yoke coupled to the linkage shaft and first and second pivot arms coupled to the yoke. The pivot arms may be attached to first and second ones of the gripping members. The first and second gripping members may be fixed about first and second associated pins that ride in associated slots in the head portion.

BRIEF DESCRIPTION OF THE DRAWING

For a better understanding of the present invention, together with other objects, features and advantages, reference should be made to the following description of the preferred embodiment which should be read in conjunction with the following figures wherein like numerals represent like parts.

DETAILED DESCRIPTION

The present invention will be described in relation to the illustrated exemplary embodiments. It is to be understood, however, that various modifications, changes, substitution of equivalents and other alterations can be made without departing from the inventive concepts.

Figure 2:
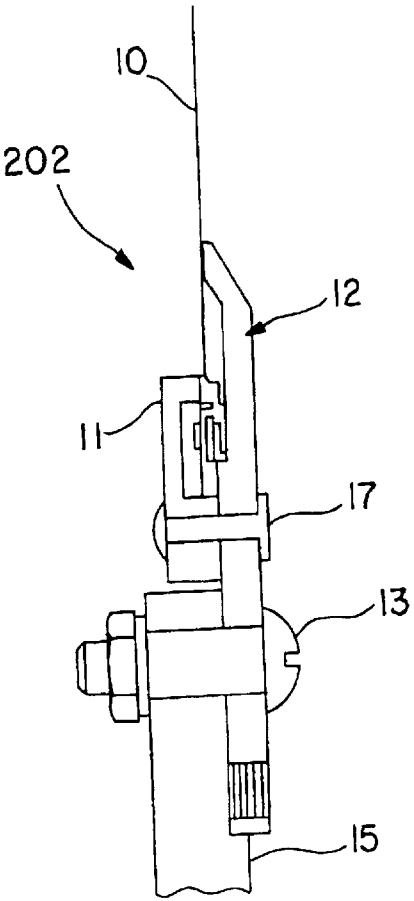
FIG. 2: is a side perspective view of a portion of the mechanism shown in FIG. 1.
Figure 1:
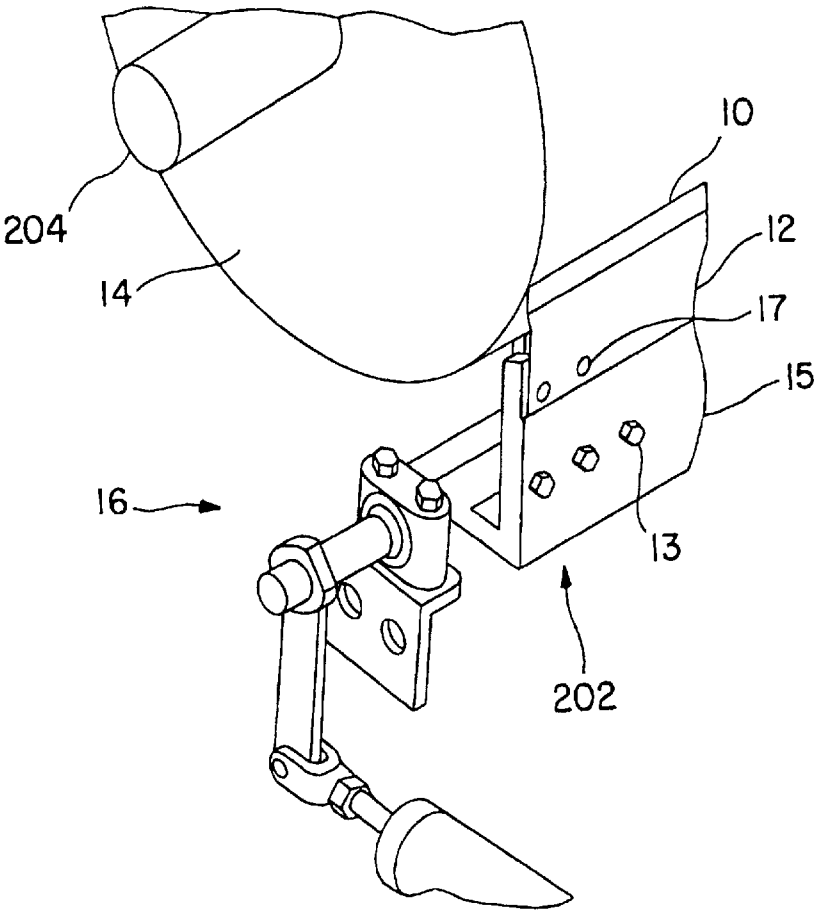
FIG. 1: is a perspective view of a prior art doctor blade mounting mechanism.

Referring now to FIGS. 1 and 2, a perspective view and side view, respectively, of a typical doctor blade mounting mechanism 202 is illustrated. The mounting mechanism 202 generally includes a blade holder 12, a finger mechanism 11, and doctor back 15. As shown in FIG. 2, the doctor blade 10 may be attached to the blade holder 12 by screw assembly 13 threaded through the blade holder and the doctor back 15, and by the finger 11 affixed to the blade holder by rivet 17. The blade may be positionable adjacent a roll 14 by an air cylinder and lever assembly 16. In use, the doctor blade cleans any debris from the roll as the roll rotates about axis 204 relative to the fixed blade 10.

Figure 3:
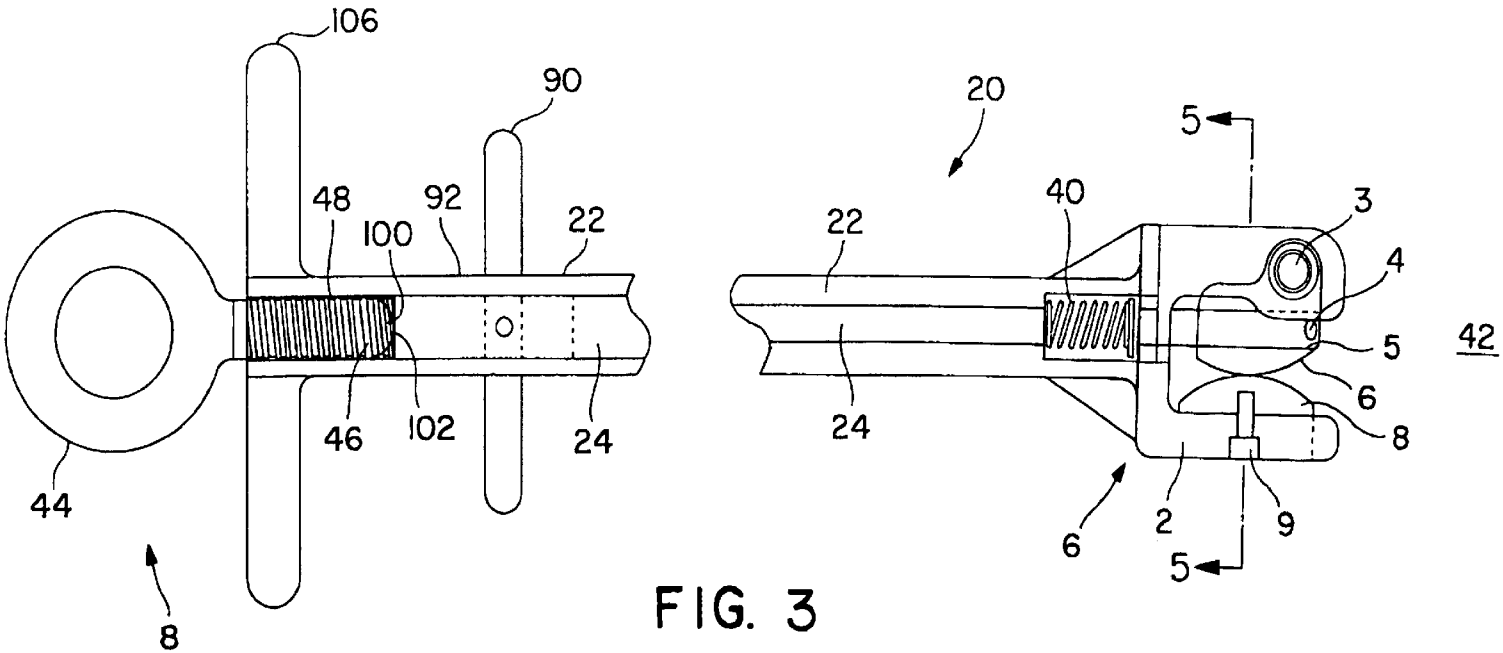
FIG. 3: is a top partial sectional view of an exemplary doctor blade extractor according to the invention in the closed position.

Consistent with the present invention, a doctor blade extractor is provided for removing a doctor blade from its associated holder. Referring to FIGS. 3–5 and 7, there is shown an exemplary embodiment of a doctor blade extractor 20, including hollow steel handle or outer shaft 22, a gripping head portion 6, and end portion 8. A spring-biased, steel locking linkage shaft 24 is slidably disposed within the steel outer shaft 22, and is coupled by swivel pin 4 located toward the front 42 of the extractor 20 to a gripping member in the form of a cam shoe 5 in the head portion 6. Gripping cam shoe 5 is rotatably mounted on pin 3 in upper arm 1 of the extractor 20. The gripping cam shoe 5 has a radiused contact surface 6 on which a knurl, serrations, or teeth may be provided. When not locked in position, spring 40 causes the gripping cam shoe 5 to rotate toward the front 42 of the extractor 20 into the closed position as shown in FIG. 3.

A safety locking ring 44 having a threaded shaft 46 matingly engages corresponding threads on the interior surface 48 of the hollow steel outer shaft 22. To cause translation of the linkage shaft 24, trigger mechanism 90 may be secured to the linkage shaft 24 through an elongate slot 92 in the outer shaft 22. By moving the trigger mechanism 90 forward, toward the front of the elongate slot 92, the linkage shaft 24 is forced toward the front 42 of the blade extractor 20 causing the gripping cam shoe 5 to rotate forward into the closed position, as shown in FIG. 3, and pressingly engage a doctor blade in the slot 60.

Figure 4:
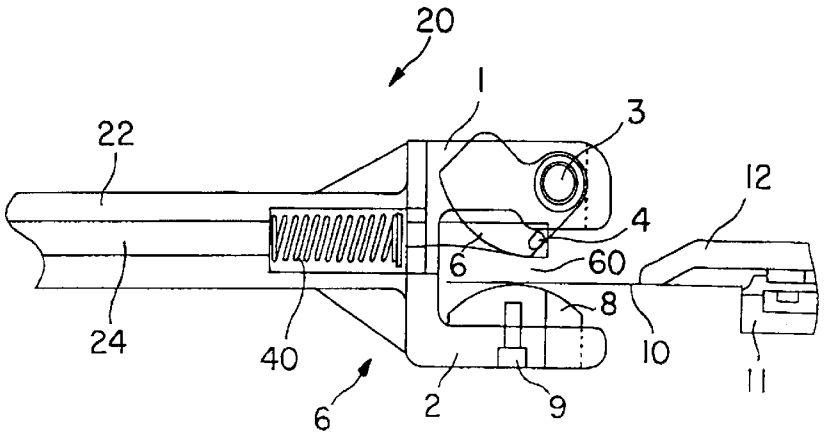
FIG. 4: is a top partial sectional view of the doctor blade extractor of FIG. 3 in the open position.
Figure 5:
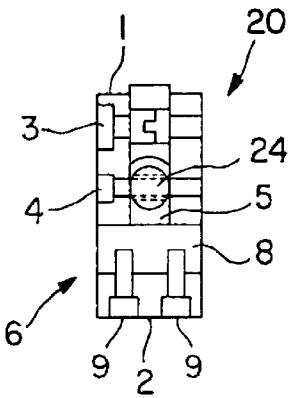
FIG. 5: is a front cross-sectional view of the doctor blade extractor of FIG. 3 taken along lines 5—5.

In use, the doctor blade 10, is inserted in receiving slot 60 in the open extractor 20 between the gripping cam shoe 5 and the radiused platform shoe 8 fixedly mounted on the lower support arm 2 by screws 9, as shown in FIGS. 4 and 5. The force of the gripping cam shoe 5 against the doctor blade 10 presses the blade against the radiused platform shoe 8 to grip and hold the doctor blade. This configuration allows the frictional cam action to grip a blade with as little as 1/16" exposure outside of the blade holder. To release the blade 10, the trigger mechanism 90 is moved toward the rear of the slot 92 thereby causing the gripping cam shoe 5 to rotate into the open position. In one embodiment, the gripping cam shoe 5 will open ¼" with a corresponding trigger pull length of 0.364".

Advantageously, once the trigger mechanism 90 is actuated toward the forward end of slot 92, the safety locking ring 44 may be used to lock the extractor 20 to the doctor blade 10 to prevent inadvertent release of the blade from the extractor. With the extractor 20 in the closed position, and the trigger mechanism 90 moved toward the front the slot 92, the safety locking ring 44 is rotated so that the meshingly engaging threads on shaft 46 of the locking ring 44 and corresponding inner surface 48 of the outer shaft 22 force end 100 of the locking ring 44 against the end 102 of the linkage shaft 24, as illustrated in FIG. 3. With the end 100 of the locking ring 44 in this position, the linkage shaft 24 is secured in place maintaining the gripping shoe 5 in the closed position around the blade 10.

With the extractor 20 in the closed position against the doctor blade 10, as a pulling force is applied, the gripping cam shoe 5 further rotates into the doctor blade 10, with a tension dependent upon the pulling force exerted. In this manner, the gripping action is increased by the frictional camming action of the gripping cam shoe 5 on the doctor blade 10. A steel handle 106 may be provided at the end 8 of the extractor 20 for providing a convenient holding position.

Advantageously, in this exemplary embodiment, the small cross-sectional width of the head enables the extractor 20 to enter very small openings to grab a blade 10. The gripping mechanism is completely enclosed by the upper 1 and lower 2 support arms so that the cross-sectional area does not change regardless if the gripping cam shoe 5 and the platform shoe 8 are in the open or closed position. The trigger mechanism 90 is located well back on the outer shaft or handle 22, which may be about 20" in length, so that hands to not need to go into small areas to open the device.

Figure 6:
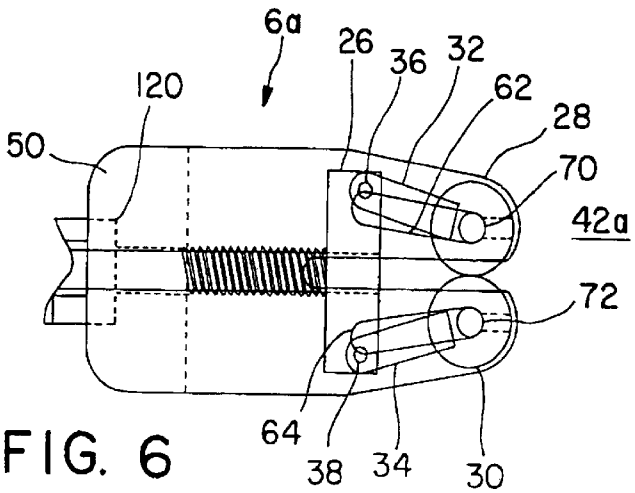
FIG. 6: is a top partial sectional view of an alternative head portion for an exemplary embodiment of a doctor blade extractor according to the invention.

Turning now to FIGS. 6, there is illustrated an alternative gripping head portion 6*a* for a doctor blade extractor 20*a* consistent with the invention. The alternative head portion 6*a* may be used in connection with the shaft 22 and end 8 portions described above. In head portion 6*a*, the steel linkage shaft 24 is coupled to locking yoke 26. The locking yoke is slidably connected between first 50 and second 52 cheek plates secured to the end 120 of the shaft 22. First 32 and second 34 pivot arms are pivotally connected to the locking yoke 26 by pivot pins 36,38, respectively, and to upper 28 and lower 30 gripping members. The gripping members are fixed about pins 70 and 72, which ride in ramped or angular slots 62 and 64 in the cheek plates 50 and 52 as the yoke translates causing rotation of the pivot arms. The gripping members 28, 30 may be knurled for gripping the doctor blade.

Spring 40 biases the yoke 26 toward the end 42*a* of the extractor 20, i.e., into a closed position. First cheek plate 50 and second cheek plate 52 define a receiving slot 60*a* toward the front 42*a* of the extractor 20*a* for receiving the doctor blade 10 during use. The end of the linkage shaft 24, spring 40, yoke 26, and the gripping members 28, 30 are therefore, disposed between the first 50 and second cheek plates 52.

As the linkage shaft 24 translates within the outer shaft 22, the yoke 26 translates, causing the pivot arms 32 and 34 to pivot about the pivot points 36 and 38 and the pins 70, 72 to travel in the slots 62,64. By moving trigger mechanism 90 to the front of slot 92, the yoke 26 is forced toward the front 42 of the extractor 20*a*. With the yoke 26 in a forward-most position, as shown in FIG. 6, pins 70, 72 are disposed at the forward ends of the slots 62 and 64, causing the gripping members 28 and 30 to extend into the receiving slot 60*a* for contacting and gripping a doctor blade (not shown) disposed within the slot 60*a*. Once the gripping members 28 and 30 are in the closed position against the doctor blade 10, the locking ring 44 is rotated against linkage shaft 24, locking the linkage shaft 24 and gripping members 28 and 30 in place. When the linkage shaft 24 is retracted, the yoke 26 retracts, causing the arms 32 and 34 to pivot upward with pins 70, 72 riding toward the rear of the slots 62,64. The gripping members 28,30 thus withdraw from the receiving slot 60*a*.

Those skilled in the art will recognize that the dimensions of the extractor are variable and may be adjusted depending on the size of the blade to be extracted, or the amount of space available for extraction. For example, in one embodiment, the width of the receiving slot 60 or 60*a* may be adjusted to accommodate any doctor blade thickness, but may be about 0.25". The length of the extractor may also be adjusted as necessary, but in an exemplary embodiment may be roughly that of a person's arm. This enables personnel to access the blades that are well inside the frame of a machine. The remote trigger release for the gripping mechanism keeps hands well clear of sharp blades and other sharp edges that can occur with rotating machinery.

An extractor consistent with the invention includes a number of features that help prevent it from slipping under great tension. One feature is the use of round or radiused serrated or knurled teeth, hardened (to approximately 50 Rockwell hardness, the hardness on the hardest blade currently in production by any manufacturer worldwide) steel shoes 5 and 8 or gripping members 28 and 30 as the gripping surfaces. The rounded or radiused surfaces put a small contact patch into direct contact with the blade 10. This allows more force in a small area to be exerted onto the blade, enabling the serrated or knurls to bite deeply into the blade.

Figure 7:
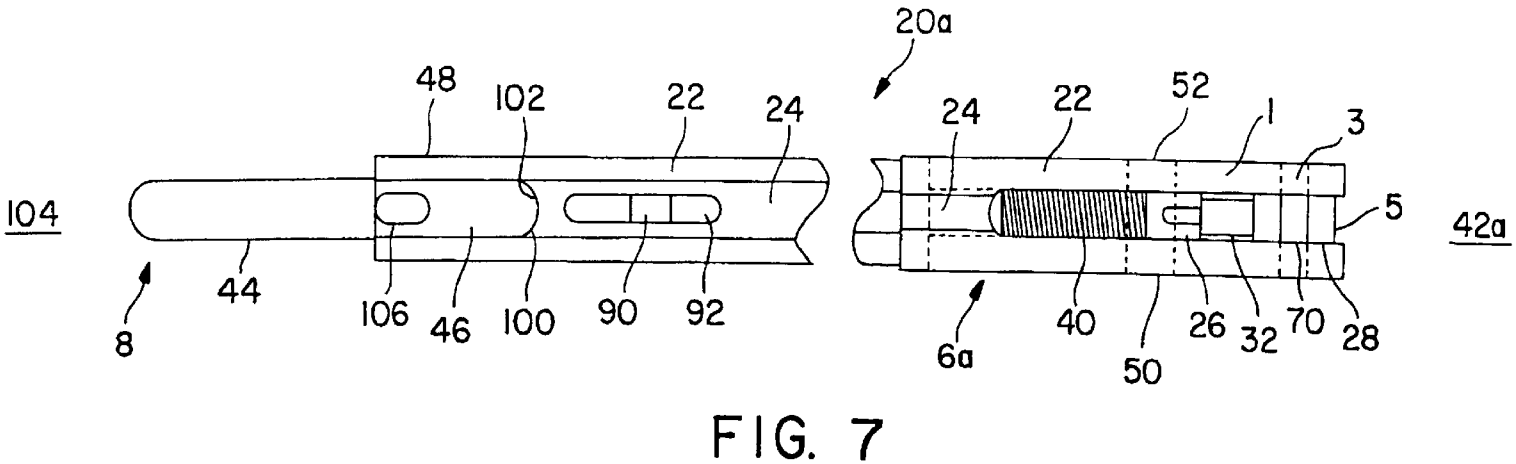
FIG. 7: is a side sectional view of the alternative head portion illustrated in FIG. 6 with the shaft and handle portion illustrated in FIG. 3.

The camming action described with respect to FIGS. 3–5,and the sliding, converging engagement feature embodied in FIGS. 6 and 7, allows the extractor to be used on any thickness blade from paper thin to the width of the jaw opening. It also acts to draw the gripping members tighter into the blade as the force of extraction increases. In essence, the harder one pulls, the tighter the grip on the blade gets.

The safety locking ring 44 tightens down on the linkage shaft 24, thereby locking it in place and the gripping mechanism in place. If the trigger mechanism 90 is inadvertently hit while this locking ring 44 is engaged, the trigger will not release. Also, by screwing down on the safety ring, the teeth of the knurled shoes 5 and 8 or gripping members 28, 30 are forced more deeply into the blade 10 than can be done by spring tension alone. This is especially important when the metal used in the blade is nearly as hard as the shoes or gripping members. Since the addition of the locking ring encourages high-tension extraction because of its locking capability, the locking ring 44 may be designed so that ¾" of thread on the ring will be engaged into the extractor handle 22 regardless of the thickness of the doctor blade 10.

Advantageously, the locking ring feature enables the extractor 20 or 20*a* to be used safely on any doctor blade with greatly reduced chance of slipping under extraction tension. In addition, the locking ring 44 provides a secure and convenient attachment point to attach some form of mechanical assistance in extraction.

The embodiments which have been described herein are but some of the several which utilize this invention, and are set forth by way of illustration but not of limitation. It is obvious that many other embodiments may be made without departing materially from the spirit and scope of this invention.

I claim:

1. A doctor blade extractor comprising:

a head portion including at least one gripping member;

a linkage shaft slidably disposed in a hollow shaft and coupled to said at least one gripping member, said linkage shaft being movable between a closed position wherein said at least one gripping member is positioned to engage a doctor blade, and an open position wherein said at least one gripping member is positioned to release said doctor blade; and a locking member for releasably locking said linkage shaft in said closed position, said locking member comprising a locking ring having threads thereon for meshingly engaging corresponding threads on an interior of said hollow shaft, said locking ring being rotatable into said hollow shaft for engaging said linkage shaft in said closed position.

2. The doctor blade extractor of claim 1, wherein at least one gripping member comprises a pivoting cam shoe coupled to said linkage shaft through a pin.

3. The doctor blade extractor of claim 2, wherein said head portion further comprises a stationary platform shoe, and wherein said cam shoe is adapted for forcing said doctor blade against said platform shoe when said linkage arm is in said closed position.

4. The doctor blade extractor of claim 1, wherein said head portion comprises a yoke coupled to said linkage shaft and first and second pivot arms coupled to said yoke, said pivot arms being attached to associated first and second gripping members.

5. The doctor blade extractor of claim 4, wherein said first and second gripping members are fixed about first and second associated pins, said pins having portions disposed in associated slots in said head portion.

6. A doctor blade extractor comprising:

a head portion including at least one gripping member;

a linkage shaft slidably disposed in a hollow shaft and coupled to said at least one gripping member, said linkage shaft being movable between a closed position wherein said at least one gripping member is positioned to engage a doctor blade, and an open position wherein said at least one gripping member is positioned to release said doctor blade;

a locking member for releasably locking said linkage shaft in said closed position; and a trigger for moving said linkage shaft between said open and closed positions, said trigger extending from said linkage shaft through a slot in said hollow shaft.

7. A doctor blade extractor comprising:

a head portion including at least one gripping member;

a linkage shaft coupled to said at least one gripping member, said linkage shaft being movable between a closed position wherein said at least one gripping member is positioned to engage a doctor blade, and an open position wherein said at least one gripping member is positioned to release said doctor blade;

a locking member for releasably locking said linkage shaft in said closed position; and a spring coupled to said linkage shaft for biasing said linkage shaft into said closed position.

8. A doctor blade extractor comprising:

a head portion comprising a pivoting cam shoe; and a linkage shaft slidably disposed in a hollow shaft and coupled to said pivoting cam shoe through a pin, said linkage shaft being movable in said hollow shaft between a closed position wherein said cam shoe is positioned to engage a doctor blade, and an open position wherein said cam shoe is positioned to release said doctor blade.

9. The doctor blade extractor of claim 8, wherein a trigger for moving said linkage shaft between said open and closed positions extends from said linkage shaft through a slot in said hollow shaft.

10. The doctor blade extractor of claim 8, wherein said head portion further comprises a stationary platform shoe, and wherein said cam shoe is adapted for forcing said doctor blade against said platform shoe when said linkage arm is in said closed position.

11. A doctor blade extractor comprising:

a head portion comprising a yoke and first and second pivot arms coupled to said yoke, each of said pivot arms being attached to an associated one of first and second gripping members; and a linkage shaft coupled to said yoke, said linkage shaft being movable between a closed position wherein said first and second gripping members are positioned to engage a doctor blade, and an open position wherein said first and second gripping members are positioned to release said doctor blade, wherein said first and second gripping members are fixed about first and second associated pins, said pins having portions disposed in associated slots in said head portion.

12. The doctor blade extractor of claim 11, wherein said linkage shaft is slidably disposed in a hollow shaft and is movable in said hollow shaft between said closed position and said open position.

13. A doctor blade extractor comprising:

a head portion comprising a yoke and first and second pivot arms coupled to said yoke, each of said pivot arms being attached to an associated one of first and second gripping members;

a linkage shaft slidably disposed in a hollow shaft and coupled to said yoke, said linkage shaft being movable in said hollow shaft between a closed position wherein said first and second gripping members are positioned to engage a doctor blade, and an open position wherein said first and second gripping members are positioned to release said doctor blade; and a trigger for moving said linkage shaft between said open and closed positions, said trigger extending from said linkage shaft through a slot in said hollow shaft.

* * * * *